US006749772B2

(12) United States Patent
Zumdome

(10) Patent No.: US 6,749,772 B2
(45) Date of Patent: Jun. 15, 2004

(54) FLUORESCENT LUBRICANT

(75) Inventor: William Zumdome, Bettendorf, IA (US)

(73) Assignee: Illinois Tool Works, Inc., Glenview, IL (US)

( * ) Notice: Subject to any disclaimer, the term of this patent is extended or adjusted under 35 U.S.C. 154(b) by 240 days.

(21) Appl. No.: 10/131,441

(22) Filed: Apr. 24, 2002

(65) Prior Publication Data

US 2003/0201423 A1 Oct. 30, 2003

(51) Int. Cl.[7] ..... C09K 11/06; C09K 11/02; C10M 133/00; F16N 15/00

(52) U.S. Cl. ..... 252/301.34; 252/301.35; 106/272; 508/100; 508/459; 508/63; 508/465; 508/505; 427/157; 427/374.4; 427/429; 427/443; 427/430.1

(58) Field of Search ..... 252/301.34, 301.35, 252/301.19; 106/272; 508/100, 459, 463, 465, 505; 427/157, 374.4, 429, 443, 430.1

(56) References Cited

U.S. PATENT DOCUMENTS 5,783,530 A 7/1998 Foster et al.

5,858,930 A 1/1999 Desai et al.

FOREIGN PATENT DOCUMENTS

| | | |
|---|---|---|
| GB | 163271 | 11/1921 |
| JP | 2001-650607 | 7/2001 |
| WO | 91 06619 | 5/1991 |

OTHER PUBLICATIONS

European Search Report for EP 03 00 5238.

*Primary Examiner*—C. Melissa Koslow
(74) *Attorney, Agent, or Firm*—Mark W. Croll, Esq.; Donald J. Breh, Esq.; Welsh & Katz, Ltd.

(57) ABSTRACT

A fluorescent lubricant that is applied to an associated object in a liquid state and dries to a solid coating is formulated from a solid lubricant present in a concentration of about 60 percent to about 80 percent of the fluorescent lubricant. The solid lubricant is a solid at room temperature. A diluent for and compatible with the solid lubricant is present in a concentration of about 10 percent to about 40 percent of the fluorescent lubricant. An optical brightener is present in a concentration of about 0.1 percent to about 5.0 percent and a fluorescent dye is present in a concentration of about 0.1 percent to about 5.0 percent of the fluorescent lubricant. The fluorescent lubricant is heated to a temperature above about 130 degrees F., is applied to the associated object and cools to form solid, lubricating fluorescent coating on the associated object. A method for coating an object with a lubricating fluorescent coating is also disclosed.

20 Claims, No Drawings

FLUORESCENT LUBRICANT

BACKGROUND OF THE INVENTION

The present invention is directed to a fluorescent lubricant. More particularly, the present invention is directed to a fluorescent lubricant that is applied as a liquid and dries to a solid state.

Parts such as fasteners are often coated with a lubricant to facilitate engaging the fastener with another object. For example, bolts are often coated with a lubricant to assist installing the bolt in, for example, a panel having a predrilled bore. Likewise, screws are often coated with a lubricant to ease driving the screw into a panel or like object, with or without a predrilled bore.

Various types of lubricants are known. Many such lubricants are provided in a liquid form, for example, as an oil. However, the oil can be inadvertently removed from the part, thus defeating the purpose of lubrication. In addition, such liquid lubricants can make the part more difficult to handle, e.g., slippery, possibly making the installation or assembly more difficult than the unlubricated part.

Solid lubricants are also known. Some of these lubricants are provided in a solid, e.g., waxy, form, and as such are difficult to apply. Others may be in a diluted form.

It is also known to mark parts. In particular, is may be desirable to mark parts with a fluorescent marking or stain when such parts are used in low-light areas. For example, when fabricating tanks and the like, it is often necessary to perform certain manufacturing tasks inside of the partially constructed tank. In such applications, the available light inside of the tank may be minimal at best. As such, it has been found useful to mark parts with a stain or marking fluid that is readily visible in low light situations, using, for example, ultraviolet lighting devices.

When using parts in low-light situations that are intended for fabrication, it is sometimes desirable to both lubricate the part, as well as provide a marking to permit locating or tracking that part. In such a use, it is necessary to lubricate the part and mark or stain the part in two separate operations. This requires additional operational steps and time. In addition, when the part is lubricated prior to staining, the stain may not hold well to the part. Conversely, when the stain is applied prior to the lubricant, the lubricant can adversely effect the ability to see or locate the part by "blocking" the fluorescence of the fluor stain.

Accordingly, there exists a need for a fluorescent lubricant that provides the ability to visually identify and locate parts, and provides a lubricant coating for ease of fabrication. Desirably, such a lubricant is applied in a liquid form and dries to form a solid or hard lubricant coating. Most desirably, such a lubricant coating is durable and resists rubbing off from the part.

BRIEF SUMMARY OF THE INVENTION

A fluorescent lubricant is applied as a liquid to an associated object and dries to a solid coating. The lubricant is formulated from a lubricant that is a solid at room temperature, a diluent, a fluorescent dye and an optical brightener.

The fluorescent lubricant is useful for providing a lubricating coating and a fluorescent marking on and object or item in a single application. A preferred fluorescent lubricant is applied as a liquid and dries relatively quickly. The preferred fluorescent lubricant adheres to parts, including metal parts and the like.

The lubricant is formulated from a solid lubricant. Preferably, the dsolid lubricant is a solid alcohol, such as cetyl alcohol or stearyl alcohol. The solid lubricant is present in a concentration of about 60 percent to about 80 percent and preferably about 70 percent of the fluorescent lubricant.

The diluent is compatible with the solid lubricant. The diluent is present in a concentration of about 10 percent to about 30 percent, and preferably about 28 percent to about 29 percent of the fluorescent lubricant. In a preferred fluorescent lubricant, the diluent is ethanol or an ethanol blend.

The fluorescent lubricant includes a fluorescent dye. A present dye is a quinoline dye that is present in a concentration of about 0.1 percent to about 5.0 percent, and preferably about 0.15 percent of the fluorescent lubricant.

To enhance the fluorescence of the fluorescent lubricant, an optical brightener is present in a concentration of about 0.1 percent to about 5.0 percent, and preferably about 1.35 percent of the fluorescent lubricant. A preferred the optical brightener is an amino coumarin derivative.

The fluorescent lubricant is heated to a temperature above about 130 degrees F., and is applied to the associated object. The fluorescent lubricant cools to form a solid, lubricating fluorescent coating on the associated object.

A method for coating an object to form a solid, lubricating fluorescent coating on the object includes the steps of providing the fluorescent lubricant formulated as above, heating the fluorescent to a temperature of at least about 130 degrees F., applying the fluorescent lubricant to the object and cooling the object having the fluorescent lubricant applied thereto to form a solid, lubricating fluorescent coating on the associated object. The coating can be applied by dipping, brushing or the like.

These and other features and advantages of the present invention will be apparent from the following detailed description, in conjunction with the appended claims.

DETAILED DESCRIPTION OF THE INVENTION

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

A fluorescent lubricant that is applied, as a liquid, to an associated object, cools to form a solid, lubricating fluorescent coating on the associated object. The fluorescent lubricant is formulated from a solid lubricant present in a concentration of about 60 percent to about 80 percent, and a diluent for and compatible with the solid lubricant. The diluent is present in a concentration of about 10 percent to about 40 percent of the fluorescent lubricant. The solid lubricant is a solid at room temperature, and liquefies as it is heated.

The fluorescent lubricant has been found to be useful for providing a lubricating coating and a fluorescent marking on items in a single application. A preferred fluorescent lubricant is of the type that is applied as a liquid that dries relatively quickly. The preferred fluorescent lubricant adheres to parts, including metal parts and the like.

In addition to providing a "one-application" lubricating and fluorescing coating, the preferred fluorescent lubricant also reduces the corrosion of parts by providing a barrier to oxygen. Moreover, because the fluorescent lubricant is not water miscible, it tends to remain on the part, as a overall protectant. Furthermore, the present fluorescent lubricant has been found to adhere to such parts without being readily removed or "rubbed off" of, or flake off of the coated parts.

The fluorescent lubricant includes a diluent for and compatible with the solid lubricant. The diluent is present in a concentration of about 10 percent to about 40 percent of the fluorescent lubricant.

The fluorescent lubricant includes a fluorescent dye present in a concentration of about 0.1 percent to about 5.0 percent, and an optical brightener that is present in a concentration of about 0.1 percent to about 5.0 percent of the fluorescent lubricant.

The fluorescent lubricant is heated to a temperature above about 130 degrees F., is applied to the associated object and cools to form a solid, lubricating fluorescent coating on the associated object.

In a contemplated fluorescent lubricant, the solid lubricant is a solid alcohol, such as cetyl alcohol (hexadecanol) or stearyl alcohol (octadecanol), and is present in a concentration of about 60 percent to about 80 percent and preferably about 70 percent of the fluorescent lubricant. These alcohols are, generally, solid (typically in flake form), water immiscible, alcohol miscible compounds. Other solid lubricants will be recognized by those skilled in the art. In a present fluorescent lubricant, cetyl alcohol is used. Cetyl alcohol (like is stearyl alcohol) is readily commercially available, such as that available from AcmeHardesty Company (a division of Jacob Stem & Sons, Inc.) of Blue Bell, Pa., under the tradename C16 Cetyl Alcohol N.F.

The present fluorescent lubricant includes a diluent or thinner to liquefy the solid lubricant alcohol. A present diluent is likewise an alcohol; however it is liquid at room temperature. The present diluent is an ethyl alcohol (ethanol) blend having minor amounts of n-propyl acetate and isopropanol. The ethanol blend is formulated having about 88 percent to about 92 percent ethanol, about 3 percent to about 7 percent n-propyl acetate and about 4.5 percent isopropanol. The ethanol blend is present in a concentration of about 10 percent to about 40 percent, and preferably about 28.5 percent of the fluorescent lubricant. Such an ethanol blend is commercially available from Ashland Specialty Chemical Company of Columbus, Ohio under the tradename Ink Solvent PM 6264. Other diluents as well as blends of diluents will be recognized by those skilled in the art and are within the scope and spirit of the present invention.

A fluorescent dye is used to provide the fluorescence for the fluorescent lubricant. In a present fluorescent lubricant, the fluorescence is provided by a quinoline dye. The quinoline dye is present in a concentration of about 0.1 percent to about 5.0 percent, and preferably about 0.15 percent of the fluorescent lubricant.

The quinoline dye is a naphthalic acid imide derivative, referred to as solvent yellow 43. Such a dye is commercially available from Keystone Aniline Corporation of Chicago, Ill. under the tradename Fluorescent Yellow R, and from Sunbelt Corporation of Rock Hill, S.C. under the trade name Morplas Fluorescent Yellow G Powder. Other dyes, as well as other colors of dyes will be recognized by those skilled in the art. The present fluorescent lubricant, although referred to as yellow in color, appears yellow under natural or ambient lighting conditions, but has a yellow/green appearance when subjected to ultraviolet light.

To enhance the florescence, the fluorescent lubricant includes an optical brightener present in a concentration of about 0.1 percent to about 5.0 percent of the fluorescent lubricant. A preferred optical brightener is an coumarin derivative in an organic solution that is present in a concentration of about 1.35 percent of the fluorescent lubricant. One known coumarin derivative in such a form is a benzo pyranone optical brightener that is commercially available from Bayer Corporation of Pittsburgh, Pa. under the tradename Blankophor SOL.

It is anticipated that other optical brighteners such as, Keywhite RWP, commercially available from Keystone Aniline Corporation of Chicago, Ill. (4-methyl, 7-diethyl amino coumarin), Fluorescent Brightener No. 140 commercially available from Indian Dyestuff Industries, Inc. of Vadadora, India, and OPTIBLANC® LSN Liquid (a dipropylene glycol monomethyl ether), commercially available from 3V Incorporated of Georgetown, S.C. can also be used for the fluorescent lubricant. Other optical brighteners will be recognized by those skilled in the art.

The present fluorescent lubricant is formulated to adhere well to the part, and to not "rub-off" when the part is contacted. Thus, it is anticipated that the parts can be coated the fluorescent lubricant, as after fabrication, and the fluorescent lubricant will remain adhered to the part in shipping and handling. In that such a coating operation is a secondary operation, that is, it does not in and of itself effectuate part fabrication, it must be a process that minimally, if at all, impacts the fabrication process and the time and cost necessary to carry out the fabrication process. Thus, a desired fluorescent lubricant dries quickly, dries well and adheres to the part. To this end, the concentration of the diluent, vis-a-solid the entity solid lubricant, must be such that it permits ready application of the fluorescent lubricant (i.e., sufficiently thins the fluorescent lubricant to permit ready application) while providing for rapid drying and a "not-easily removed" coating.

Those skilled in the art will, however, appreciate that the present fluorescent lubricant can be used in a variety of applications. For example, the fluorescent lubricant can be applied by dipping the object, e.g., a bolt, in the fluorescent lubricant when in a liquid state. Alternately, the be fluorescent lubricant can be brushed onto the object. Alternately still, it is anticipated that the fluorescent lubricant applied by spray or aerosol application.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A fluorescent lubricant that is applied as a liquid to an associated object and dries to a solid coating comprising:

a solid lubricant present in a concentration of about 60 percent to about 80 percent of the fluorescent lubricant, the solid lubricant being a solid at room temperature;

a diluent for and compatible with the solid lubricant present in a concentration of about 10 percent to about 40 percent of the fluorescent lubricant;

an optical brightener present in a concentration of about 0.1 percent to about 5.0 percent of the fluorescent lubricant; and a fluorescent dye present in a concentration of about 0.1 percent to about 5.0 percent of the fluorescent lubricant, wherein the fluorescent lubricant is heated to a temperature above about 130 degrees F., is applied to the associated object and cools to form a solid, lubricating fluorescent coating on the associated object.

2. The fluorescent lubricant in accordance with claim 1 wherein the solid lubricant is an alcohol that is solid at room temperature.

3. The fluorescent lubricant in accordance with claim 2 wherein the solid alcohol is present in a concentration of about 70 percent of the fluorescent lubricant.

4. The fluorescent lubricant in accordance with claim 3 wherein the alcohol is cetyl alcohol.

5. The fluorescent lubricant in accordance with claim 3 wherein the alcohol is stearyl alcohol.

6. The fluorescent lubricant in accordance with claim 1 wherein the diluent is an alcohol that is a liquid at room temperature.

7. The fluorescent lubricant in accordance with claim 6 wherein the alcohol is ethanol.

8. The fluorescent lubricant in accordance with claim 7 wherein the ethanol is present in a concentration of about 28.5 percent of the fluorescent lubricant.

9. The fluorescent lubricant in accordance with claim 1 wherein the fluorescent dye is a quinoline dye.

10. The fluorescent lubricant in accordance with claim 9 wherein the quinoline dye is present in a concentration of about 0.15 percent of the fluorescent lubricant.

11. The fluorescent lubricant in accordance with claim 1 wherein the optical brightener is an amino coumarin.

12. The fluorescent lubricant in accordance with claim 1 wherein the amino coumarin is present in a concentration of about 1.35 percent of the fluorescent lubricant.

13. A fluorescent lubricant that is applied as a liquid to an associated object and dries to a solid coating comprising:

a solid lubricant selected from the group consisting cetyl alcohol and stearyl alcohol present in a concentration of about 70 percent of the fluorescent lubricant, the solid lubricant being a solid at room temperature;

a diluent for and compatible with the solid lubricant present in a concentration of about 10 percent to about 30 percent of the fluorescent lubricant;

an optical brightener present in a concentration of about 0.1 percent to about 5.0 percent of the fluorescent lubricant, the optical brightener being an amino coumarin; and a fluorescent dye present in a concentration of about 0.1 percent to about 5.0 percent of the fluorescent lubricant, the fluorescent dye being a quinoline dye, wherein the fluorescent lubricant is heated to a temperature above about 130 degrees F., is applied to the associated object and cools to form a solid, lubricating fluorescent coating on the associated object.

14. The fluorescent lubricant in accordance with claim 13 wherein the diluent is an alcohol.

15. The fluorescent lubricant in accordance with claim 14 wherein the alcohol is ethanol present in a concentration of about 28.5 percent of the fluorescent lubricant.

16. The fluorescent lubricant in accordance with claim 13 wherein the quinoline dye is present in a concentration of about 0.15 percent of the fluorescent lubricant.

17. The fluorescent lubricant in accordance with claim 13 wherein the amino coumarin optical brightener is present in a concentration of about 1.35 percent of the fluorescent lubricant.

18. A method for coating an object to form a solid, lubricating fluorescent coating on the object, comprising the steps of:

providing a fluorescent lubricant formulated from a solid lubricant present in a concentration of about 60 percent to about 80 percent of the fluorescent lubricant, the solid lubricant being a solid at room temperature, a diluent for and compatible with the solid lubricant present in a concentration of about 10 percent to about 40 percent of the fluorescent lubricant, an optical brightener present in a concentration of about 0.1 percent to about 5.0 percent of the fluorescent lubricant and a fluorescent dye present in a concentration of about 0.1 percent to about 5.0 percent of the fluorescent lubricant, heating the fluorescent to a temperature of at least about 130 degrees F.;

applying the fluorescent lubricant to the object;

cooling the object having the fluorescent lubricant applied thereto to form a solid, lubricating fluorescent coating on the associated object.

19. The method in accordance with claim 18 wherein the fluorescent lubricant is applied by dipping.

20. The method in accordance with claim 18 wherein the fluorescent lubricant is applied by brushing.

* * * * *